US009723960B2

(12) United States Patent
Borges et al.

(10) Patent No.: US 9,723,960 B2
(45) Date of Patent: Aug. 8, 2017

(54) VACUUM NOZZLE

(71) Applicants: Richard Borges, Clifton, NJ (US); Joanny Borges, Clifton, NJ (US)

(72) Inventors: Richard Borges, Clifton, NJ (US); Joanny Borges, Clifton, NJ (US)

( * ) Notice: Subject to any disclaimer, the term of this patent is extended or adjusted under 35 U.S.C. 154(b) by 0 days.

(21) Appl. No.: 14/812,754

(22) Filed: Jul. 29, 2015

(65) Prior Publication Data

US 2015/0320275 A1 Nov. 12, 2015

Related U.S. Application Data

(63) Continuation-in-part of application No. 13/485,868, filed on May 31, 2012, now abandoned.

(51) Int. Cl.

| | |
|---|---|
| ***B08B 5/04*** | (2006.01) |
| ***A47L 9/02*** | (2006.01) |
| ***A47L 9/06*** | (2006.01) |

(52) U.S. Cl.

CPC ..... *A47L 9/02* (2013.01); *A47L 9/0606* (2013.01); *A47L 9/0693* (2013.01)

(58) Field of Classification Search

CPC ..... A47L 9/02; A47L 9/0693; B08B 5/04

USPC ..... D32/32

See application file for complete search history.

(56) References Cited

U.S. PATENT DOCUMENTS

| | | | | |
|---|---|---|---|---|
| 2,668,979 | A * | 2/1954 | MacFarland | A47L 9/0444 15/368 |
| 5,502,870 | A * | 4/1996 | Ragner | A47L 9/02 15/393 |
| 2006/0107488 | A1* | 5/2006 | Lee | A47L 9/02 15/398 |
| 2009/0188067 | A1* | 7/2009 | White | A47L 9/02 15/246.2 |
| 2011/0010888 | A1* | 1/2011 | Jonsson | A47L 9/02 15/415.1 |
| 2013/0167322 | A1* | 7/2013 | Huang | A47L 9/02 15/418 |

* cited by examiner

*Primary Examiner* — Douglas Lee

(74) *Attorney, Agent, or Firm* — Miskin & Tsui-Yip LLP; Gloria Tsui-Yip, Esq.

(57) ABSTRACT

A vacuum nozzle with a vacuum hose receptacle and two wing members pivotably connected to each order. Each wing member has a corresponding opening that is in fluid communication with the vacuum hose receptacle. The two wing members may be positioned at different angles to effectively vacuum a flat surface or at a corner of any degree angle formed from two adjacent surfaces (e.g., wall and floor or two vertical walls).

10 Claims, 11 Drawing Sheets

VACUUM NOZZLE

CROSS-REFERENCE TO RELATED APPLICATION

This is a continuation-in-part of pending U.S. patent application Ser. No. 13/485,868 filed on May 31, 2012, which is hereby incorporated by reference.

FIELD OF THE INVENTION

The present invention relates to vacuum nozzles and, more particularly, to a vacuum nozzle that can be effectively used to vacuum a flat surface or two flat surfaces that are disposed at an angle (such as a horizontal floor and a vertical wall) simultaneously.

BACKGROUND OF THE INVENTION

When cleaning with a vacuum cleaner having a prior art nozzle, it may be easy to clean the floor, but more difficult to clean the vertical wall or corner molding that is typically placed along the wall at the floor. Some vacuum nozzles may swivel and allow a user to vacuum a floor first, then swivel the head, and pass along the corner molding in a second pass. This however, takes time and requires a nozzle that can swivel. Without such a swiveling nozzle, a user may find himself bending over and holding the vacuum at an awkward angle in order to vacuum the corner molding.

Moreover, conventional vacuum nozzles, while they may be designed to get as close to the corner as possible, can never get completely into a corner (between the floor and the wall corner molding) because there always needs to be a nozzle housing that results in a gap therebetween.

Similarly, it is difficult to effectively clean the corner formed between two vertical walls that runs from the floor to the ceiling where cobwebs can often be found. A conventional vacuum nozzle may be used to first run vertically along one wall adjacent the corner, then a second pass along the other vertical wall is required. Even then, it is impossible for the vacuum nozzle to reach into the corner from floor to ceiling.

As can be seen, there is a need for an improved vacuum nozzle that is capable of cleaning two adjacent surfaces disposed at an angle simultaneously, while also not leaving any gaps between the two surfaces.

SUMMARY OF THE INVENTION

In one aspect of the present invention, a vacuum nozzle comprises a vacuum hose receptacle for attaching a vacuum hose; and a nozzle member having an opening formed at a substantially 90 degree angle, such that the opening is operable to face two surfaces disposed at a 90 degree angle, such as a floor and a wall, simultaneously.

In another aspect of the present invention, a vacuum nozzle comprises a vacuum hose receptacle for attaching a vacuum hose; a nozzle member having an opening formed at a substantially 90 degree angle in fluid communication with the vacuum hose receptacle, such that the opening is operable to face two surfaces disposed at a 90 degree angle, such as a floor and a wall, simultaneously; brushes disposed along an outer periphery of the opening; an angled edge formed at the 90 degree angle in the nozzle member; and a plurality of internal support pins disposed to support the opening of the nozzle member.

In a further aspect of the present invention, a method for vacuuming comprises attaching a vacuum nozzle to a vacuum hose extension, wherein the vacuum nozzle includes a vacuum hose receptacle for attaching a vacuum hose and a nozzle member having an opening formed at a substantially 90 degree angle; disposing the vacuum nozzle along a 90 degree corner formed between two surfaces, where the opening faces each of the two surfaces; and vacuuming both surfaces at the same time by moving the vacuum nozzle along the corner formed between the two surfaces.

In another embodiment of the present invention, the vacuum nozzle member comprises a vacuum hose receptacle and two wing members pivotably connected to each other. Each wing member has a corresponding opening. The two wing members may be positioned at various angles from between about 90 degree to about 180 degree, depending on the application. To vacuum a flat surface, the two wing members are positioned at an angle of about 180 degree such that the openings of both wing members face the same direction to resemble a prior art vacuum nozzle. To vacuum two surfaces disposed at an angle relative to each other, the two wing members are positioned at the appropriate angle such that the respective openings of the wing members face each surface for effective cleaning.

These and other features, aspects and advantages of the present invention will become better understood with reference to the following drawings, description and claims.

DETAILED DESCRIPTION OF THE INVENTION

Figure 1:
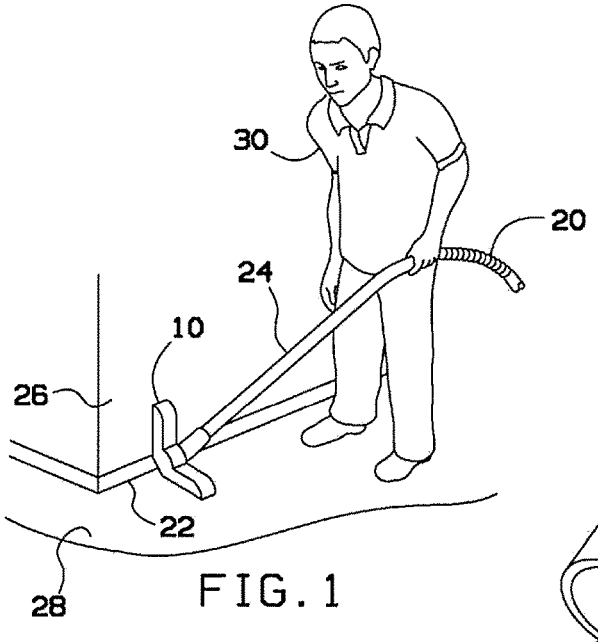
FIG. 1 is a perspective view of a vacuum nozzle of the present invention being used.
Figure 2:
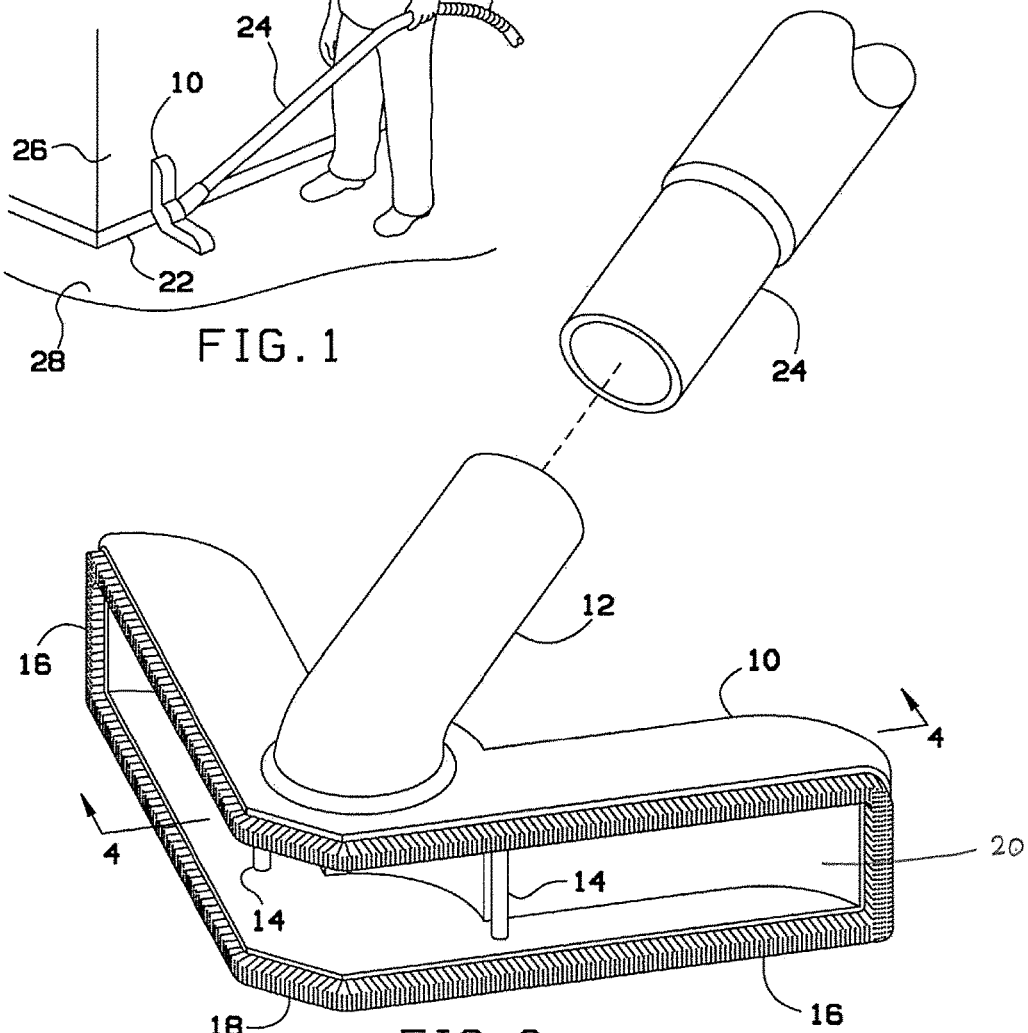
FIG. 2 is a front perspective view of the vacuum nozzle of FIG. 1.
Figure 3:
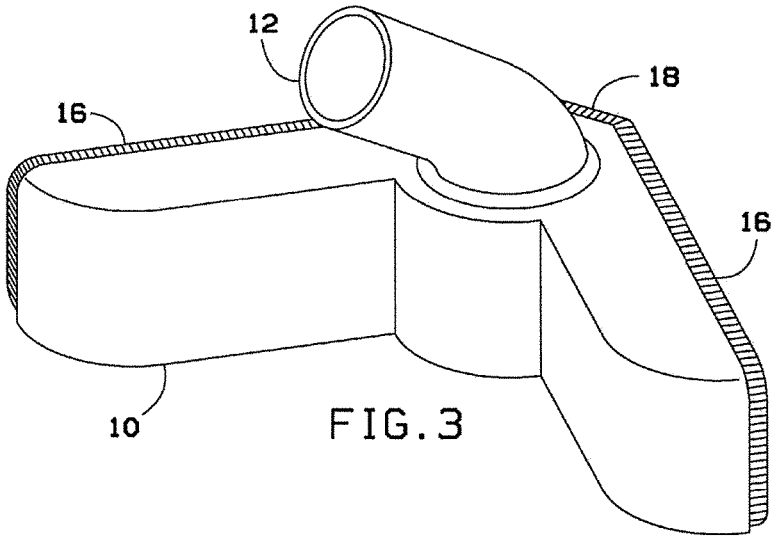
FIG. 3 is a rear perspective view of the vacuum nozzle of FIG. 1.
Figure 4:
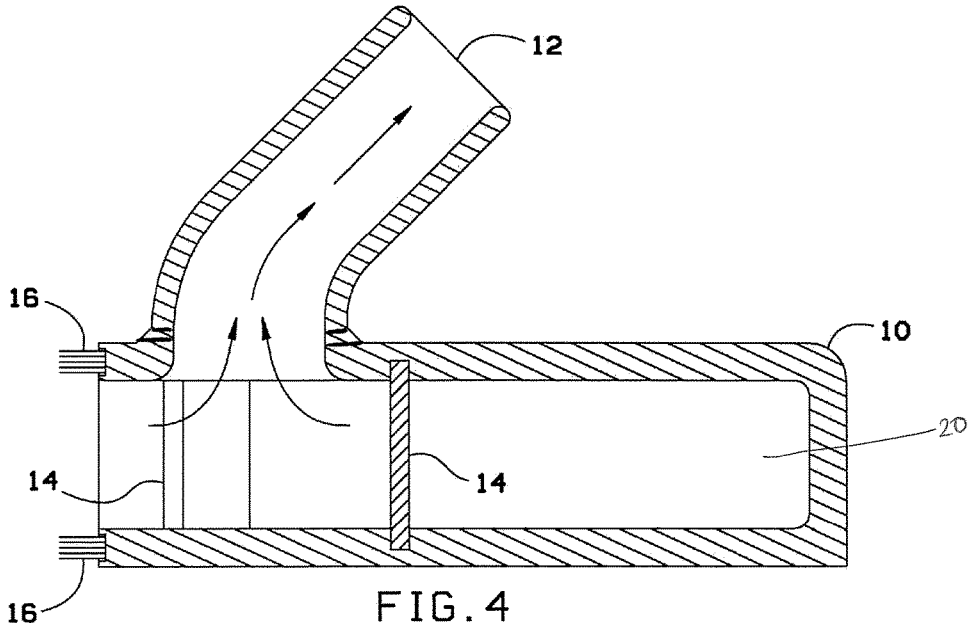
FIG. 4 is a cross-sectional view taken along line 4-4 of FIG. 2.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, the embodiments of the present invention provide a vacuum nozzle that is angled to any desired angle to be able to vacuum two surfaces that are disposed at an angle relative to each other, such as a floor portion and a floor molding at the same time. Unlike conventional vacuum nozzles that are flat, the nozzle as herein described is angled, typically at about 90 degrees, to fit into the corner along where the wall meets the floor or where two walls meet. The nozzle can also be used, for example, where the ceiling meets the wall, or any other such corner of any angles to provide a vacuum cleaning thereto.

Referring now to FIGS. 1 through 4, a vacuum nozzle 10 includes a vacuum hose receptacle 12 adapted to connect to a vacuum hose extension 24 which may attach to a vacuum hose 20. In some embodiments, the vacuum nozzle 10 may be designed to fit on both the vacuum hose 20 and the vacuum hose extension 24. The vacuum hose receptacle 12 may be designed in various sizes to fit on different vacuum hoses 24. The vacuum hose receptacle 12 may further include various clips, adaptors and the like to be able to attach to various manufacturers of vacuums that may include a clip mechanism to secure the nozzle onto the vacuum hose.

The vacuum nozzle 10 may be formed at an angle, typically a 90 degree angle, at its opening 20, to fit into a corner formed by a wall 26 and a floor 28. The wall 26 may include corner molding 22 formed there along and the nozzle 10 may include an angled edge 18, beveling the 90 degree angle of the vacuum nozzle 10, that may accommodate the corner molding 22, as shown in FIG. 1.

The vacuum nozzle 10 may include a plurality of internal support pins 14 to help stabilize the nozzle along its opening 20.

Figure 11:
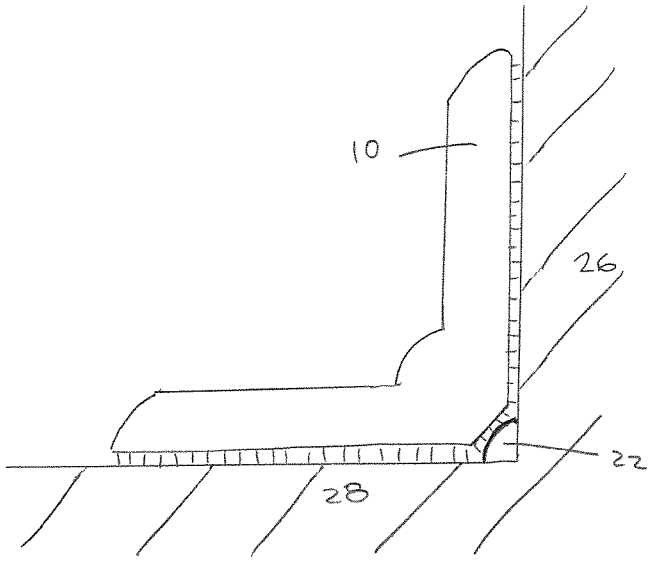
FIG. 11 is a view of the vacuum nozzle of FIG. 1 being used against two surfaces.

To use the vacuum nozzle 10, a user 30 may simply move the opening 20 of the nozzle 10 along the corner formed by the wall 26 and the floor 28, cleaning both the lower part of the wall 26, the corner molding 22 and the floor 28 (including the very edge of the floor 28) at the same time, as further illustrate in FIG. 11. Similarly, a user 30 may move the opening 20 of the nozzle 10 along a corner formed between two vertical walls by raising the nozzle 10 up and down along the corner between the floor and the ceiling.

The vacuum nozzle 10 may swivel on the vacuum hose receptacle 12 to permit the vacuum nozzle 10 to be used on both the left hand and the right hand sides of the user 30.

Brushes 16 may be formed along an outer periphery of the opening 20 of the vacuum nozzle 10. The brushes 16 may be formed in various shapes and lengths and can be formed of various materials. In some embodiments, the brushes may be about half-inch high soft bristles.

The vacuum nozzle 10 may be made from various materials in various conventional manufacturing processes. For example, the vacuum nozzle 10 may be made from plastic, metal, composite, or the like. Typically, the vacuum nozzle 10 may be made from plastic.

FIGS. 5-10 show a second embodiment of the nozzle 110 of the present invention. Similar to the nozzle 10, nozzle 110 includes a vacuum hose receptacle 112 adapted to connect to a vacuum hose extension 24 which may be attach to a vacuum hose 20. Unlike vacuum hose receptacle 12 where it extends from a side of the nozzle 10 at an angle, vacuum hose receptacle 112 extends substantially perpendicular from a side of the nozzle 110. However, the vacuum hose receptacle 112 can similarly extend from the nozzle 110 at an angle. Alternatively, an adaptor 129 may be removably attached by any means known to one skilled in the art (such as by friction, latch, bayonet, hook and loop, clamp, etc.) to vacuum hose receptacle 112 to provide such an angle. Such an adaptor 129 may itself be adjustable to provide different positioning and angles.

The nozzle 110 is formed from two wing members 122*a* and 122*b*. Each wing member 122*a* and 122*b* has a corresponding opening 120*a* and 120*b* and joint element 124*a* and 124*b*. The openings 120*a* and 120*b* are in fluid communication with the vacuum hose receptacle 112. Each joint element 124*a* and 124*b* includes a disc element 126*a* and 126*b*, a ring element 128*a* and 128*b*, and a curve wall 130*a* and 130*b*. Each disc element 126 is spaced apart from and connected to the ring element 128 via the curve wall 130. Disc element 126*a* is positioned to sealingly abut and overlap disc element 126*b*. Ring element 128*a* is positioned to sealingly abut and overlap ring element 128*b*, which sealingly abuts vacuum hose receptacle 112. Curve wall 130*a* is positioned to sealingly abut and overlap curve wall 130*b*.

Figure 5:
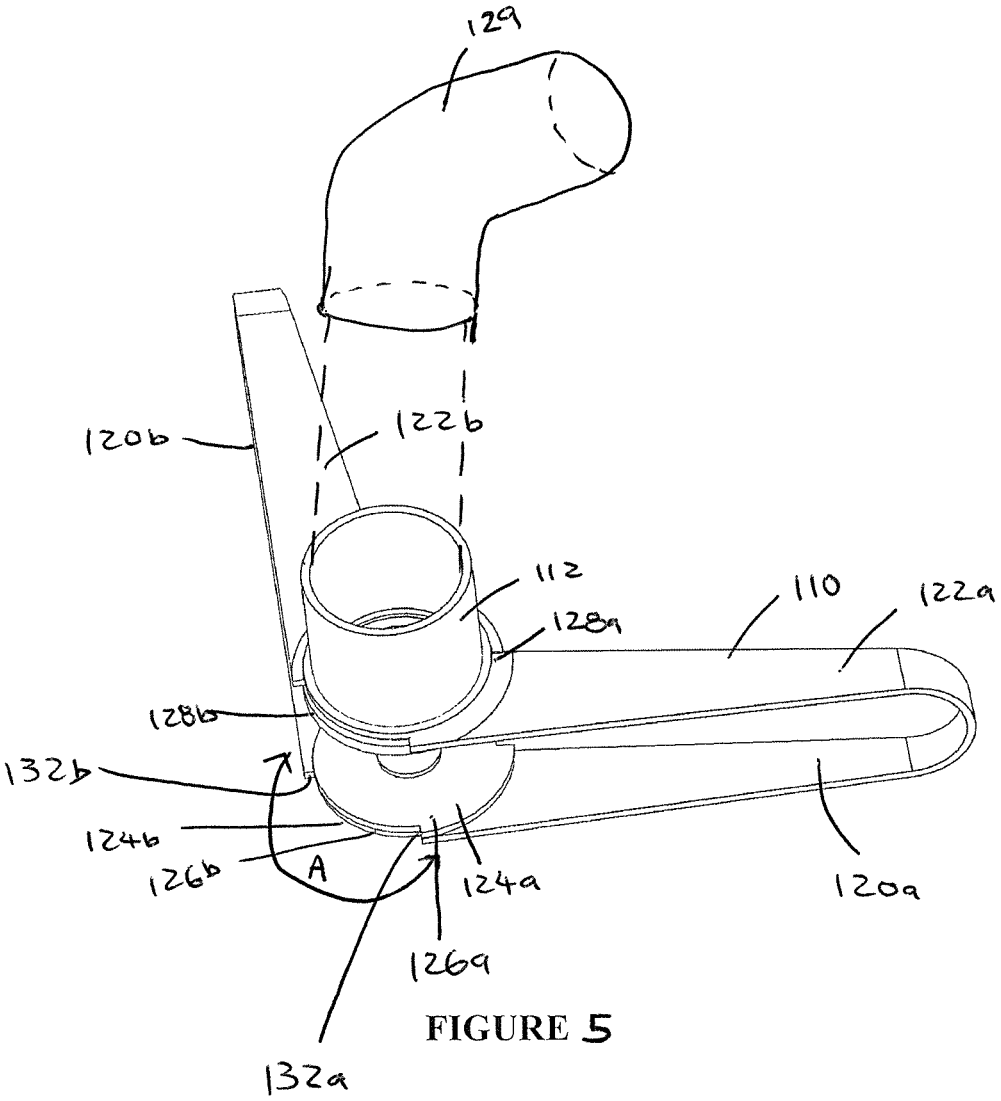
FIG. 5 is a front perspective view of a second embodiment of the vacuum nozzle of the present invention in a first configuration of about 90 degrees.
Figure 6:
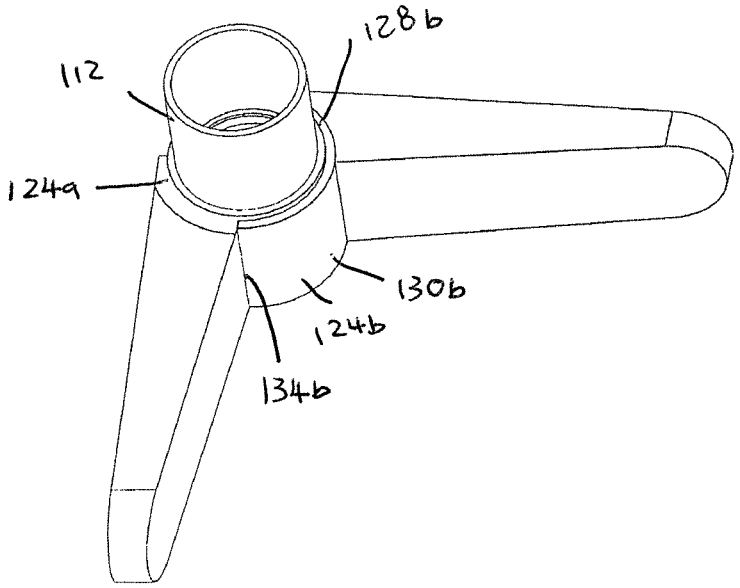
FIG. 6 is a top perspective view of the vacuum nozzle of FIG. 5.
Figure 7:
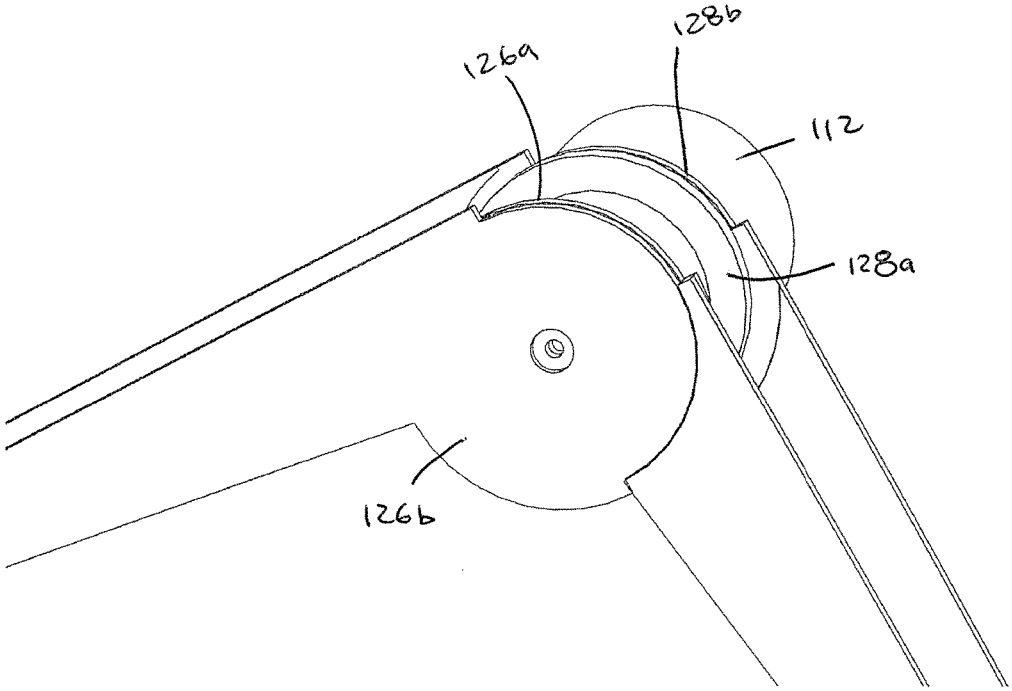
FIG. 7 is a close up view of the pivotal joint of the vacuum nozzle of FIG. 5.
Figure 8:
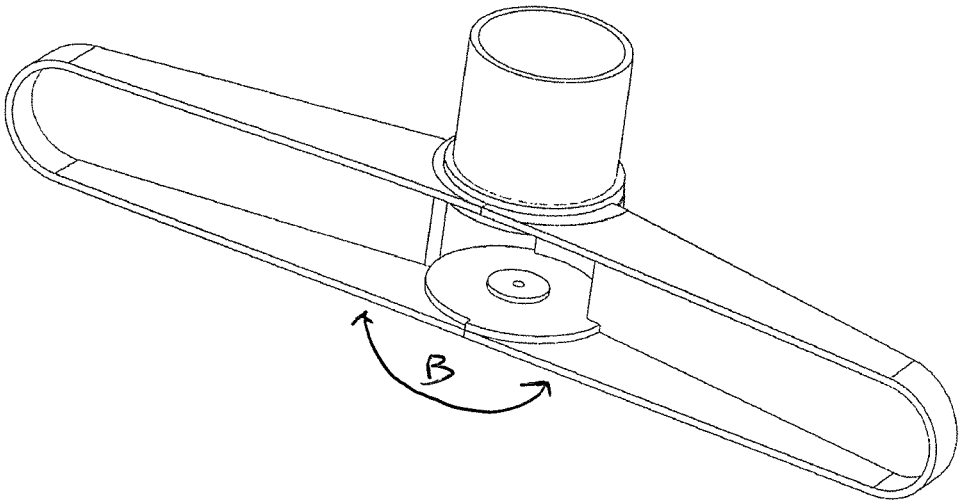
FIG. 8 is a front perspective view of the vacuum nozzle of FIG. 5 in an alternate configuration of about 180 degrees.
Figure 9:
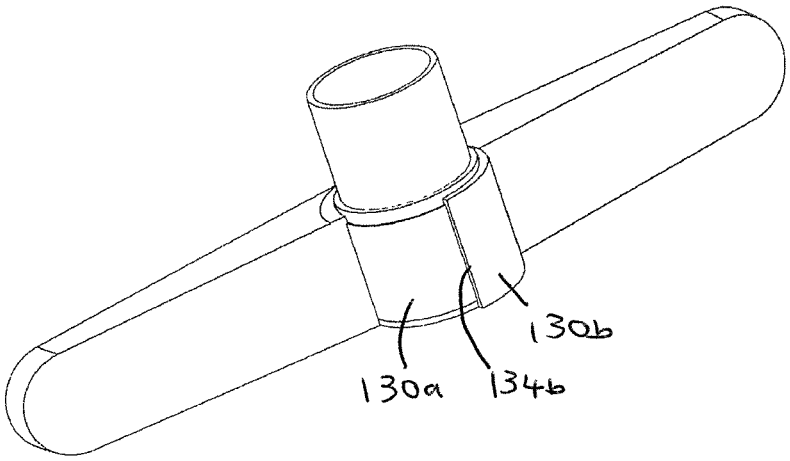
FIG. 9 is a top perspective view of the vacuum nozzle of FIG. 8.
Figure 10:
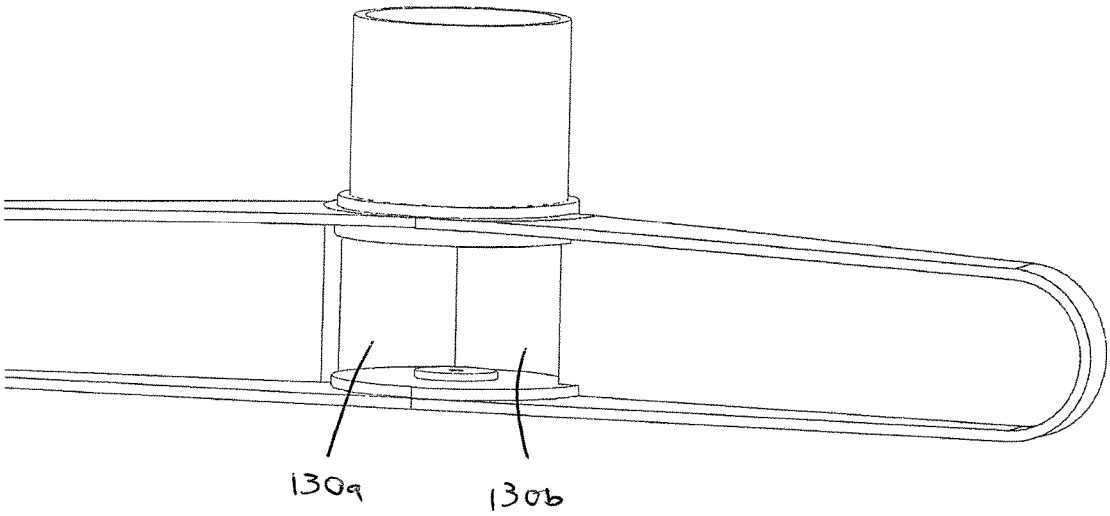
FIG. 10 is a close up view of the pivotal joint of the vacuum nozzle of FIG. 8.

The joint elements 124*a* and 124*b* rotate relative to each other along the same axis of rotation such that wing members 122*a* and 122*b* are pivotable relative to each other to allow openings 120*a* and 120*b* to face an angle of between 180 degree (see angle B in FIG. 8) to about 270 degree (see angle A in FIG. 5). Each disc element 126 includes a notch 132*a* and 132*b* that prevent the openings 120*a* and 120*b* to face an angle less than about 180 degrees. The length of the curve wall 130*b* limits the maximum angle the openings 120*a* and 120*b* can face because the distal end 134*b* of the curve wall 130*b* would touch the wing member 122*a* (see FIG. 6 and compare with FIG. 9).

Figure 12:
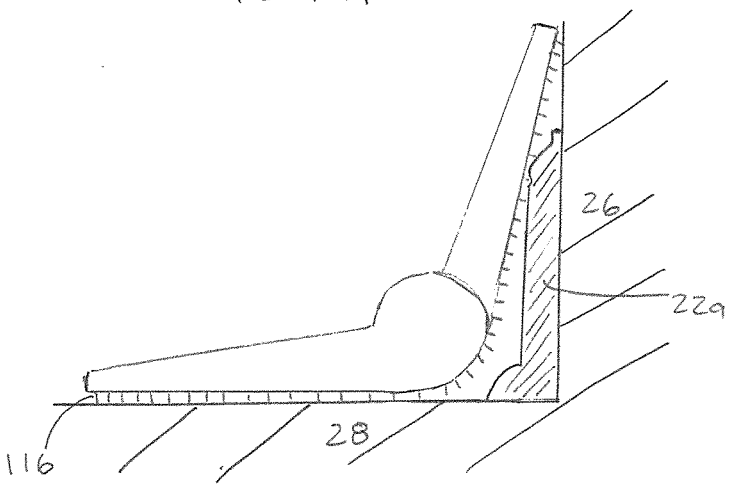
FIG. 12 is a view of the vacuum nozzle of FIG. 8 in another alternate configuration of greater than 90 degrees.
Figure 13:
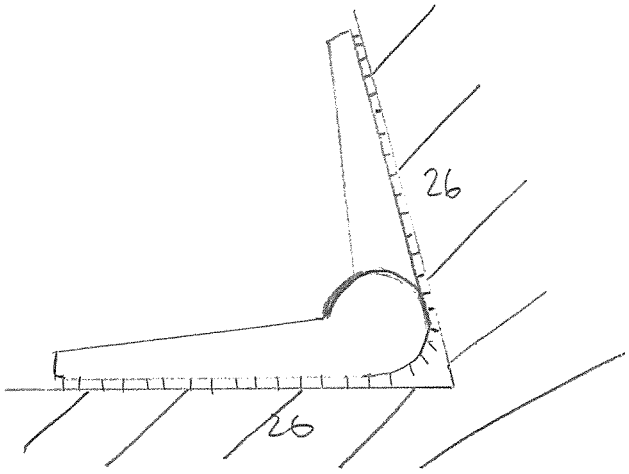
FIG. 13 is a view of the vacuum nozzle of FIG. 8 is yet another alternate configuration of less than 90 degrees.

FIGS. 12 and 13 illustrate nozzle 110 with the openings 120*a* and 120*b* positioned to face different angles. FIG. 12 shows a vertical wall 26, a horizontal floor 28 and an elaborate molding 22*a* at the bottom of vertical wall 26. Nozzle 10 with a fixed 90 degree angle (i.e. with opening having a 270 degree angle) cannot effectively vacuum clean such a configuration. On the other hand, wing members 122*a* and 122*b* of nozzle 110 can be positioned such that the openings 120*a* and 120*b* face an angle of less than 270 degree to be able to effectively vacuum clean such configuration. Joint elements 124*a* and 124*b* provide a rounded edge (similar to the angled edge 18 of nozzle 10) to accommodate lower part of molding 22*a*. FIG. 13 shows two vertical walls 26 forming an angle less than 90 degree. Wing members 122*a* and 122*b* are positioned such that the openings 120*a* and 120*b* face an angle of more than 90 degree to be able to effectively vacuum clean such configuration.

Figure 14:
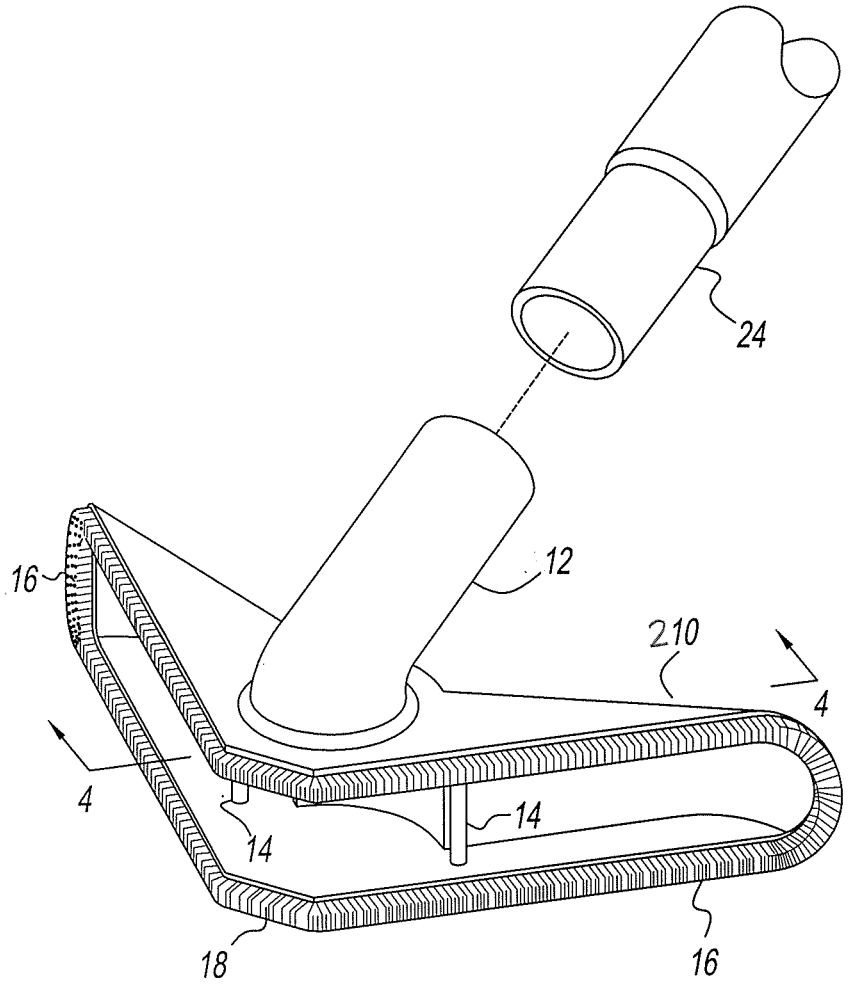
FIG. 14 is a front perspective view of a third embodiment of the vacuum nozzle of the present invention
Figure 15:
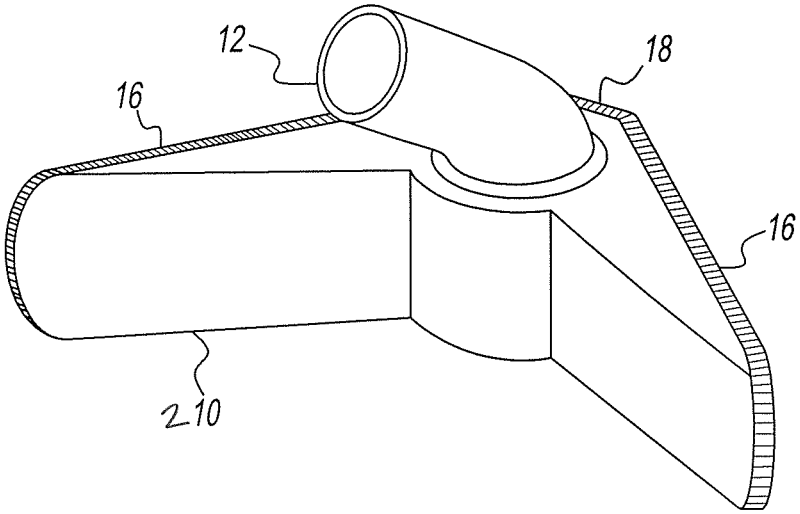
FIG. 15 is a rear perspective view of the vacuum nozzle of FIG. 14.

Similar to the nozzle 10, brushes or bristles 116 may be provided along the periphery of openings 120*a* and 120*b* of nozzle 110 (see FIG. 12). Similarly, internal support pins 14 of nozzle 10 may also be provided for nozzle 110 (not shown). Although the shape of the nozzle 110 is slightly tapered (i.e. each wing member 122 having a tapered distal end) in comparison with the shape of the nozzle 10, the shapes can be interchangeable between nozzle 10 and 110 without detracting from the functionality of the vacuum nozzle of the present invention. FIGS. 14 and 15 show a nozzle 210 having another shape that can be used for the present invention.

It should be understood, of course, that the foregoing relates to exemplary embodiments of the invention and that modifications may be made without departing from the spirit and scope of the invention as set forth in the following claims.

The invention claimed is:

1. A vacuum nozzle for use with a vacuum cleaner having a vacuum hose to vacuum first and second planar surfaces that are between about 90 degrees to about 180 degrees to each other and a corner formed between said first and second planar surfaces, comprising:

(a) a vacuum hose receptacle having a central axis adapted to removably connect to the vacuum hose, wherein said central axis is perpendicular to both the first and second planar surfaces;

(b) a nozzle member having first and second wing members pivotably connected to each other, each wing member having a corresponding opening adapted to face said first and second planar surfaces, respectively, and a corresponding joint element having an axis of rotation the same as said central axis of said vacuum hose receptacle connected to said vacuum hose receptacle, said openings of said nozzle member are in direct fluid communication with said vacuum hose receptacle;

wherein said joint elements of said first and second wing members overlap each other and rotate relative to each other along said axis of rotation such that the opening of said first wing member is adapted to face said first planar surface and the opening of said second wing member is adapted to pivotably face said second planar surface at any angle between about 180 degree to about 270 degree from said first planar surface and said openings of said first and second wing members at said overlapping joint elements are adapted to face said corner.

2. The vacuum nozzle of claim 1 further comprising brushes disposed along an outer periphery of said openings.

3. The vacuum nozzle of claim 1, further comprising a plurality of internal support pins disposed to support the openings of said nozzle member.

4. The vacuum nozzle of claim 1, wherein said vacuum hose receptacle is rotatable relative to said nozzle member.

5. The vacuum nozzle of claim 1, wherein each joint element comprises:

(a) a disc element;

(b) a ring element spaced apart from said disc element; and (c) a curved wall connecting said disc element to said ring element.

6. The vacuum nozzle of claim 5, wherein said disc and ring elements are substantially parallel to each other.

7. The vacuum nozzle of claim 5, wherein said disc elements of said first and second wing members are positioned to sealingly abut and overlap each other, said ring elements of said first and second wing members are positioned to sealingly abut and overlap each other, said vacuum hose receptacle is positioned to sealingly abut one of said ring element, and said curve walls of said first and second wing members are positioned to sealingly abut and overlap each other.

8. The vacuum nozzle of claim 5 wherein said disc element having a notch that prevents said openings from facing an angle of less than about 180 degree.

9. The vacuum nozzle of claim 5 wherein said curve wall having a length that limits said opening from facing an angle of more than about 270 degree.

10. A method for vacuuming a corner formed between first and second planar surfaces disposed at a predetermined angle between about 90 degrees to about 180 degrees to each other, using a vacuum cleaner having a vacuum hose, comprising the steps of:

(a) providing a vacuum hose receptacle having a central axis, wherein said central axis is perpendicular to both the first and second planar surfaces;

(b) providing a nozzle member having first and second wing members pivotably connected to each other, each wing member having a corresponding opening adapted to face said first and second planar surfaces, respectively, and a corresponding joint element having an axis of rotation the same as said central axis of said vacuum hose receptacle connected to said vacuum hose receptacle, said openings of said nozzle member are in direct fluid communication with said vacuum hose receptacle;

wherein said joint elements of said first and second wing members overlap each other and rotate relative to each other along said axis of rotation such that the openings of said first and second wing members are pivotable to face an angle of between about 180 degree to about 270 degree;

(c) attaching the vacuum hose to the vacuum hose receptacle;

(d) positioning the opening of said first wing member to face the first planar surface and positioning the opening of the second wing member to face the second planar surface;

(e) positioning said openings of said first and second wing members at said overlapping joint elements to face said corner; and moving said nozzle member along said corner to vacuum both first and second planar surfaces and the corner.

* * * * *